US007032639B2

(12) United States Patent
Lukasiewicz, Jr. et al.

(10) Patent No.: US 7,032,639 B2
(45) Date of Patent: Apr. 25, 2006

(54) GOLF PUTTER AND METHOD FOR MANUFACTURING THE GOLF PUTTER

(75) Inventors: Robert Lukasiewicz, Jr., Portland, OR (US); Carl L. Madore, Portland, OR (US); Cole Byron Slaughter, Grandbury, TX (US); David N. Franklin, Grandbury, TX (US)

(73) Assignee: Nike, Inc., Beaverton, OR (US)

( * ) Notice: Subject to any disclaimer, the term of this patent is extended or adjusted under 35 U.S.C. 154(b) by 0 days.

(21) Appl. No.: 11/050,677

(22) Filed: Feb. 7, 2005

(65) Prior Publication Data

US 2005/0137028 A1 Jun. 23, 2005

Related U.S. Application Data

(62) Division of application No. 10/641,283, filed on Aug. 15, 2003, now Pat. No. 6,986,716.

(51) Int. Cl.
*B22D 19/00* (2006.01)

(52) U.S. Cl. ..... 164/98; 164/112

(58) Field of Classification Search ..... 164/98, 164/112

See application file for complete search history.

(56) References Cited

U.S. PATENT DOCUMENTS

| | | | | |
|---|---|---|---|---|
| D161,790 | S | | 1/1951 | Sappington |
| D234,960 | S | | 4/1975 | Swash |
| D235,668 | S | | 7/1975 | Swash |
| 4,558,505 | A | * | 12/1985 | Moore ..... 29/527.6 |
| D316,129 | S | | 4/1991 | Bryson |
| D320,638 | S | | 10/1991 | Mermillod |
| 5,058,895 | A | | 10/1991 | Igarashi |
| D340,962 | S | | 11/1993 | Phillips |
| D349,319 | S | | 8/1994 | Bayer |
| 5,333,871 | A | * | 8/1994 | Wishon ..... 473/350 |
| 5,398,746 | A | * | 3/1995 | Igarashi ..... 164/98 |
| 5,456,464 | A | | 10/1995 | Davenport et al. |
| 5,595,234 | A | * | 1/1997 | Beck ..... 164/9 |
| 5,630,765 | A | | 5/1997 | Moore |
| 5,749,791 | A | | 5/1998 | Passeri, Jr. |
| 5,797,176 | A | * | 8/1998 | Rose et al. ..... 29/527.5 |
| 5,823,244 | A | * | 10/1998 | Hsieh ..... 164/112 |
| 5,830,078 | A | | 11/1998 | McMahan |
| 5,868,635 | A | * | 2/1999 | Aizawa et al. ..... 473/324 |
| 5,871,407 | A | | 2/1999 | Tseng |
| D410,056 | S | | 5/1999 | McMahan |
| 5,938,543 | A | * | 8/1999 | McGeeney et al. ..... 473/324 |
| 5,951,412 | A | | 9/1999 | Rose et al. |
| 6,080,070 | A | | 6/2000 | Whitley |
| D437,017 | S | | 1/2001 | Ford |
| 6,350,208 | B1 | | 2/2002 | Ford |
| 6,386,991 | B1 | | 5/2002 | Reyes et al. |
| 6,475,427 | B1 | | 11/2002 | Deshmukh et al. |
| 6,986,716 | B1 | * | 1/2006 | Lukasiewicz et al. ..... 473/340 |

* cited by examiner

*Primary Examiner*—Kevin P. Kerns
(74) *Attorney, Agent, or Firm*—Banner & Witcoff, Ltd.

(57) ABSTRACT

A golf putter includes a shalt and a head secured to the shalt. The head includes a forward portion that defines a face, and the head includes a rear portion positioned rearward of the face. The rear portion may have the configuration of a ring structure. Whereas the forward portion is formed of a first material, the rear portion may be formed of a different material with greater density. In manufacturing the head, the rear portion may be formed and then placed within a mold having the shape of the entire head. Molten first material is then introduced into the mold to form the forward portion.

14 Claims, 6 Drawing Sheets

Figure 2
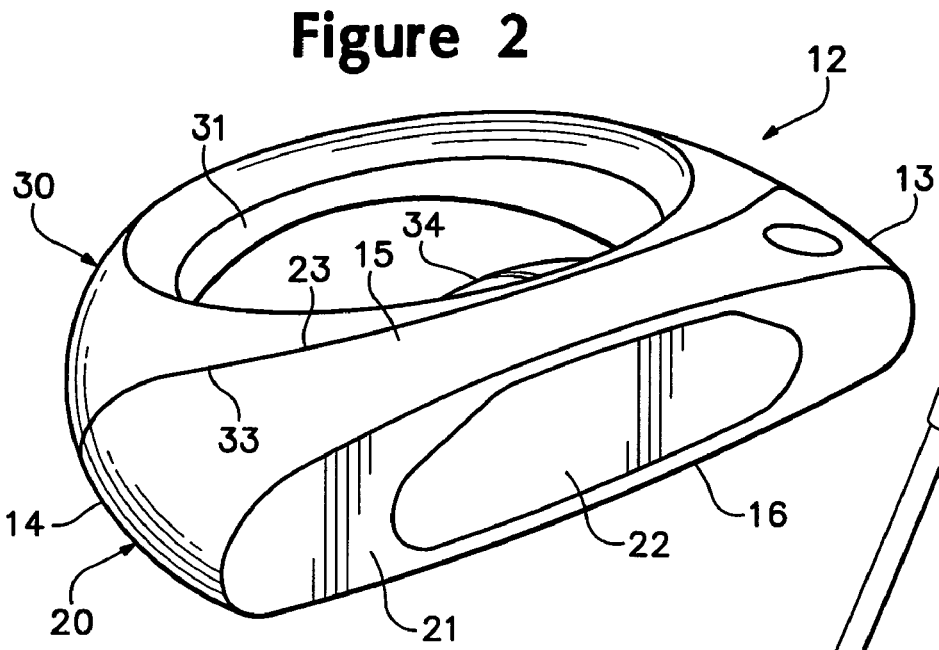
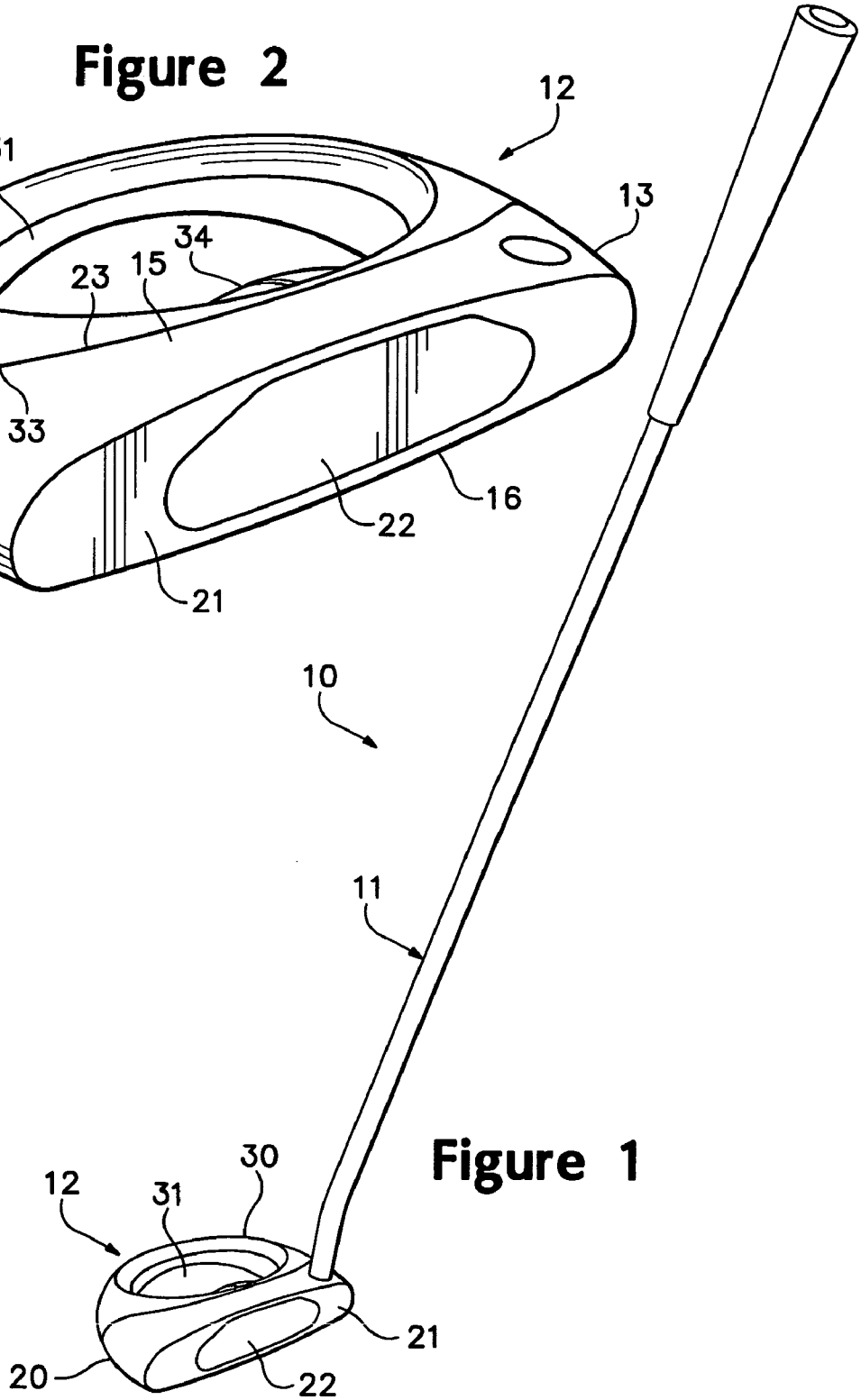
Figure 1

GOLF PUTTER AND METHOD FOR MANUFACTURING THE GOLF PUTTER

CROSS-REFERENCE TO RELATED APPLICATION

This non-provisional U.S. Patent Application is a divisional application of U.S. patent application Ser. No. 10/641,283, which was filed in the U.S. Patent and Trademark Office on Aug. 15, 2003 now U.S. Pat. No. 6,986,716 and entitled Golf Putter and Method For Manufacturing the Golf Putter.

BACKGROUND OF THE INVENTION

1. Field of the Invention

The present invention relates to equipment for the sport of golf and concerns, more particularly, a golf putter and a method for manufacturing the golf putter.

2. Description of Background Art

The formal origins of the game of golf, one of the oldest international sports, dates to the $16^{th}$ century at The Royal and Ancient Golf Club at St. Andrews, located in Scotland. During successive centuries, the game of golf has gained and maintained a populous following due to inherent challenges of the game, a prestigious reputation, and its suitability for relaxation. Due to an increasing growth in the number of individuals playing the game of golf, manufacturers of golf equipment, which includes golf clubs, balls, footwear, and bags, regularly improve upon the various features and characteristics of the golf equipment. Golf equipment has, therefore, evolved over time to provide enhanced performance and suitability for a wide range of playing abilities and styles, with many of the advances relating to the configuration and materials that are utilized in the golf equipment.

A golf club has two primary elements, a shaft and a head. The shaft is a thin, elongate structure that may be formed from graphite or steel materials, for example. A first end of the shaft may include may include a textured rubber coating to provide an area for an individual to securely grasp the golf club. A second end of the shaft is fastened to the head, which includes a substantially planar contact surface for engaging a golf ball. In use, the individual will grasp the first end of the shaft and swing the golf club such that the head contacts the golf ball and propels the golf ball in an intended direction and toward an intended target, such as a hole.

Commonly utilized types of golf clubs include drivers, woods, irons, and putters. Whereas the drivers, woods, and irons are generally utilized to propel the golf ball through the air, putters are utilized to induce the golf ball to roll across the ground (i.e., a green). As with other types of golf clubs, putters include a head that has a substantially planar contact surface for engaging a golf ball and propelling the golf ball in an intended direction.

The structure of a putter may have an effect upon the direction traveled by the golf ball. For example, one factor that has an effect upon whether the golf ball is propelled in the intended direction relates to a position of a center of gravity of the golf club head. When the center of gravity is positioned behind the point of engagement on the contact surface, the golf ball follows a generally straight route. In circumstances where the center of gravity is spaced to a side of the point of engagement, however, the golf ball may follow a route that angles left or right. Another factor that has an effect upon whether the golf ball is propelled in the intended direction relates to a moment of inertia of the golf club head. When the moment of inertia is relatively large, the golf club head resists rotating upon contact with the golf ball and the golf ball follows a generally straight route. In circumstances where the golf club head rotates, however, the golf ball may follow a route that angles left or right. Manufacturers of golf equipment attempt, therefore, to configure putters and other golf clubs such that the center of gravity is spaced from the face of the golf club and the moment of inertia is relatively large to resist rotation.

SUMMARY OF THE INVENTION

The present invention is a golf club head having a forward portion and a rear portion. The forward portion is positioned in a front area of the golf club head, and the forward portion forms a face for contacting a golf ball. The rear portion is secured to the forward portion and is positioned in a rear area of the golf club head.

The forward portion and the rear portion may be formed of different materials. In order to shift the center of gravity of the golf club head rearward relative to the face, the forward portion may be formed of a material with a lesser density than the rear portion. For example, the forward portion may be formed from aluminum, and the rear portion may be formed from steel.

The rear portion may form a ring structure that defines an aperture extending through the golf club head, and the aperture may extend from an upper surface to a lower surface of the golf club head. The aperture may have a generally elliptical shape, or one of a variety of other shapes. In addition, a protrusion may extend from an inner surface of the ring structure, and the protrusion may be positioned adjacent to the forward portion.

Another aspect of the invention involves a method of manufacturing the golf club head. In general, the method includes forming the rear portion, placing the rear portion into a mold, and molding the forward portion by introducing a molten material into the mold and adjacent the rear portion. The rear portion may be formed through a casting process, such as investment casting. In addition, a plate may be positioned adjacent the rear portion to limit flow of the molten material.

The advantages and features of novelty characterizing the present invention are pointed out with particularity in the appended claims. To gain an improved understanding of the advantages and features of novelty, however, reference may be made to the following descriptive matter and accompanying drawings that describe and illustrate various embodiments and concepts related to the invention.

DESCRIPTION OF THE DRAWINGS

The foregoing Summary of the Invention, as well as the following Detailed Description of the Invention, will be better understood when read in conjunction with the accompanying drawings.

FIG. 1 is an elevational view of a golf club having a head in accordance with the present invention.

FIG. 2 is a perspective view of the head.

DETAILED DESCRIPTION OF THE INVENTION

Figure 3:
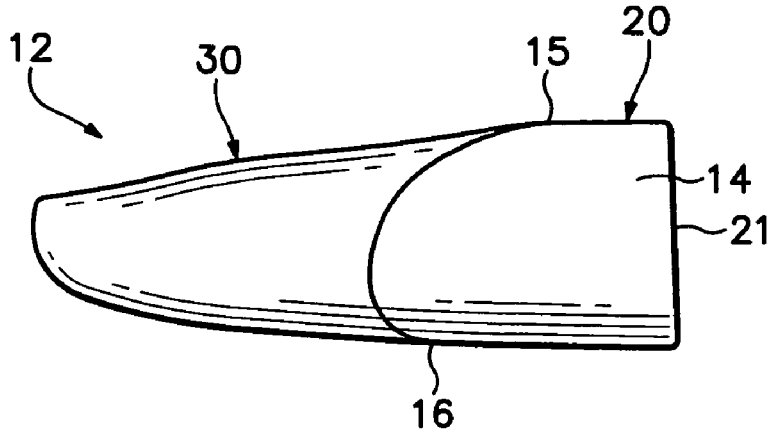
FIG. 3 is a side elevational view of the head.
Figure 4:
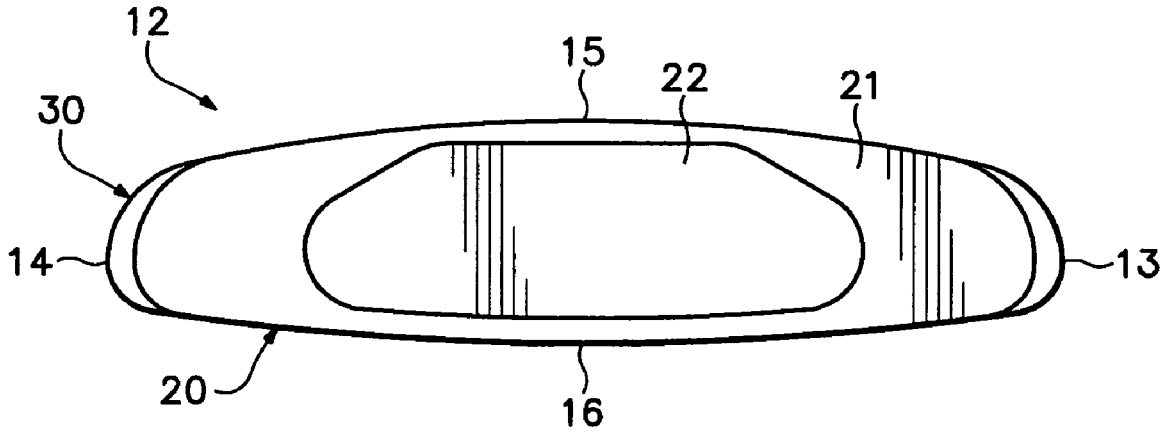
FIG. 4 is a front elevational view of the head.

The following discussion and accompanying figures disclose a golf club, particularly a putter, in accordance with the present invention. With reference to FIG. 1, the primary elements of golf club 10 are a shaft 11 and a head 12. Shaft 11 has a generally elongate configuration and may be formed of conventional materials, including graphite or steel. A grip may extend over a first end of shaft 11 to provide a comfortable and slip-resistant area for grasping golf club 10. Head 12 is secured to a second end of shaft 11 and is configured to engage a golf ball, thereby propelling the golf ball in an intended direction. As depicted in the figures, head 12 provides golf club 10 with the structure of a putter. Within the scope of the present invention, however, general concepts related to the configuration of head 12 may provide golf club 10 with the structure of another type of golf club, including a driver, wood, or iron, for example.

Head 12 is depicted individually in FIGS. 2–7 and includes a forward portion 20 and a rear portion 30. Head 12 may also include a plate 40 that is positioned between forward portion 20 and rear portion 30. For purposes of reference, head 12 includes a heel side 13 that is adjacent to the foot of the individual when utilizing golf club 10, and head 12 includes an opposite toe side 14 that faces away from the foot of the individual when utilizing golf club 10. In addition, head 12 includes an upper surface 15 and an opposite lower surface 16. Although sides 13–14 and surfaces 15–16 apply generally to head 12, references to sides 13–14 and surfaces 15–16 also apply specifically to forward portion 20 and rear portion 30.

Forward portion 20 is positioned in a front area of head 12 and defines a generally planar face 21 for engaging a golf ball. Face 21 may have a textured configuration for gripping or otherwise limiting the degree to which the golf ball slides against face 21. In operation, face 21 engages the golf ball and propels the golf ball in the intended direction. In effect, therefore, the golf ball rebounds from face 21. The degree to which the golf ball is propelled is partially determined by the coefficient of restitution of the material forming face 21. In circumstances where the material forming forward portion 20 has a suitable coefficient of restitution, the entirety of forward portion 20 may be formed of the same material. In order to modify the coefficient of restitution of forward portion 20, however, an insert 22 having a different coefficient of restitution may be embedded within face 21.

Forward portion 20 also includes a connection side 23 positioned opposite face 21. Connection side 23 interfaces with rear portion 30 and plate 40, thereby securing forward portion 20 to head 12. Whereas, face 21 has a generally planar configuration, connection side 23 is curved and includes a generally semi-circular protrusion 24 positioned adjacent lower surface 16. In addition, an aperture or concavity may be formed in forward portion 20 to receive the second end of shaft 11 and secure head 12 to shaft 11.

The depth of forward portion 20 may be generally defined as a dimension between upper surface 15 and lower surface 16. Both upper surface 15 and lower surface 16 have a generally curved and convex configuration, with upper surface 15 exhibiting a greater degree of curvature than lower surface 16. The depth of forward portion 20 is, therefore, at a minimum in portions of forward portion 20 that correspond with heel side 13 and toe side 14, and the depth of forward portion 20 is at a maximum in central areas of forward portion 20. Similarly, the thickness of forward portion 20 may be generally defined as a dimension between face 21 and connection side 23. Areas of forward portion 20 positioned adjacent heel side 13 and toe side 14 have a greater thickness than central areas due to the concave curvature of connection side 23.

Figure 5:
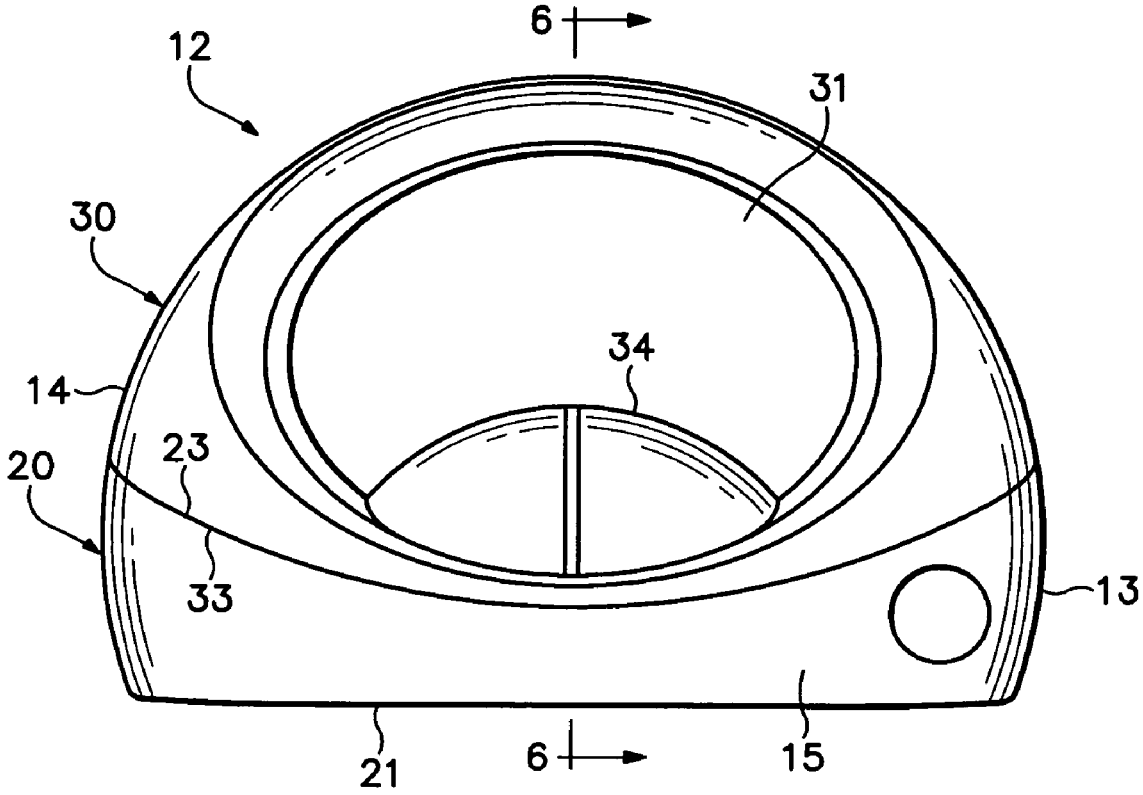
FIG. 5 is a top plan view of the head.
Figure 6:
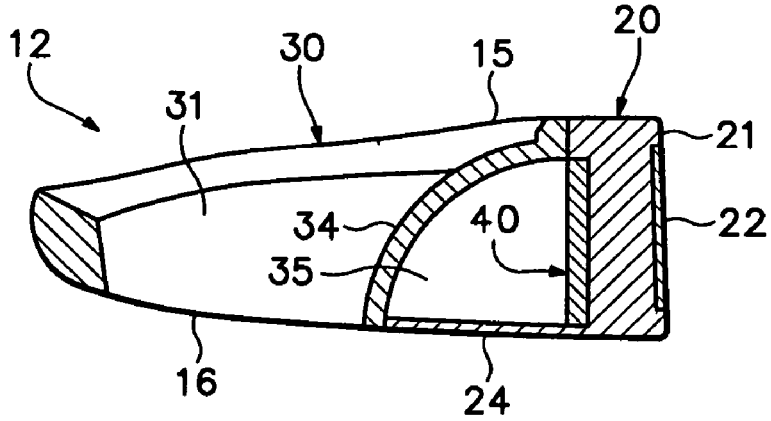
FIG. 6 is a cross-sectional view of the head, as defined by section line 6—6 in FIG. 5.

Rear portion 30 is positioned in a rearward area of head 12 and is positioned substantially rearward of forward portion 20. Rear portion 30 has the general configuration of a ring structure that defines an aperture 31. Aperture 31 has a generally elliptical shape, but may also be round, square, triangular, or rectangular within the scope of the present invention. In addition, aperture 31 may have a plurality of other geometric or non-geometric shapes. In some embodiments where aperture 31 has an elliptical shape, aperture 31 may have a major axis length of approximately 6.7 centimeters and a minor axis length of approximately 4.8 centimeters. As depicted in FIG. 5, the rearmost portion of aperture 31 is curved and the thickness of rear portion 30 is substantially constant in the rearmost portion of aperture 31. Rear portion 30 also includes a connection side 33 that interfaces with forward portion 20 and plate 40. Positioned within aperture 31 and adjacent to connection side 33 is a protrusion 34 that extends over protrusion 24 of forward portion 20. Although rear portion 30 may form the ring structure discussed above and depicted in the figures, the ring structure may be absent in some embodiments of the invention.

As with forward portion 20, the depth of rear portion 30 may be generally defined as a dimension between upper surface 15 and lower surface 16. In areas of rear portion 30 that are adjacent to connection side 33, the depth of rear portion 30 is substantially the same as the depth of forward portion 20 at connection side 23. Accordingly, upper surface 15 and lower surface 16 smoothly transition between forward portion 20 and rear portion 30. As rear portion 30 extends rearward, the depth decreases due to a downward incline in upper surface 15 and an upward curvature in lower surface 16. In addition, the thickness of rear portion 30 may be defined as the dimension between the surface of aperture 31 and the outward-facing surface of rear portion 30. In the area of rear portion 30 that is adjacent to connection side 33 and centrally-located, the thickness is relatively thin. The thickness of rear portion 30 increases, however, in the areas of rear portion 30 that are adjacent to connection side 33 and also adjacent to heel side 13 and toe side 14. As rear portion 30 extends rearward, the thickness decreases and is relatively constant in areas that are opposite connection side 33.

Protrusion 34 is located adjacent to connection side 33 and is centrally-located with respect to heel side 13 and toe side 14. The shape of protrusion 34 is depicted as being quarter-spherical in shape, but may have a variety of shapes within the scope of the present invention. Connection sides 23 and 33 form a vertical interface between connection portion 20 and rear portion 30. As discussed above, however, protrusion 34 extends over protrusion 24, thereby forming a horizontal interface between connection portion 20 and rear portion 30. A line or other indicia may be engraved or printed, for example, on protrusion 34 to provide the individual with a sighting line for aligning the golf ball with face 21. Protrusion 34 extends outward from the interior surface of aperture 31 and protrudes at least partially across aperture 31. As discussed above, aperture 31 may have a major axis length of approximately 6.7 centimeters and a minor axis length of approximately 4.8 centimeters. For purposes of example, protrusion 34 may extend approximately 4.5 centimeters in the direction of the major axis, and protrusion 34 may protrude along approximately 1.5 centimeters of the minor axis.

Figure 7:
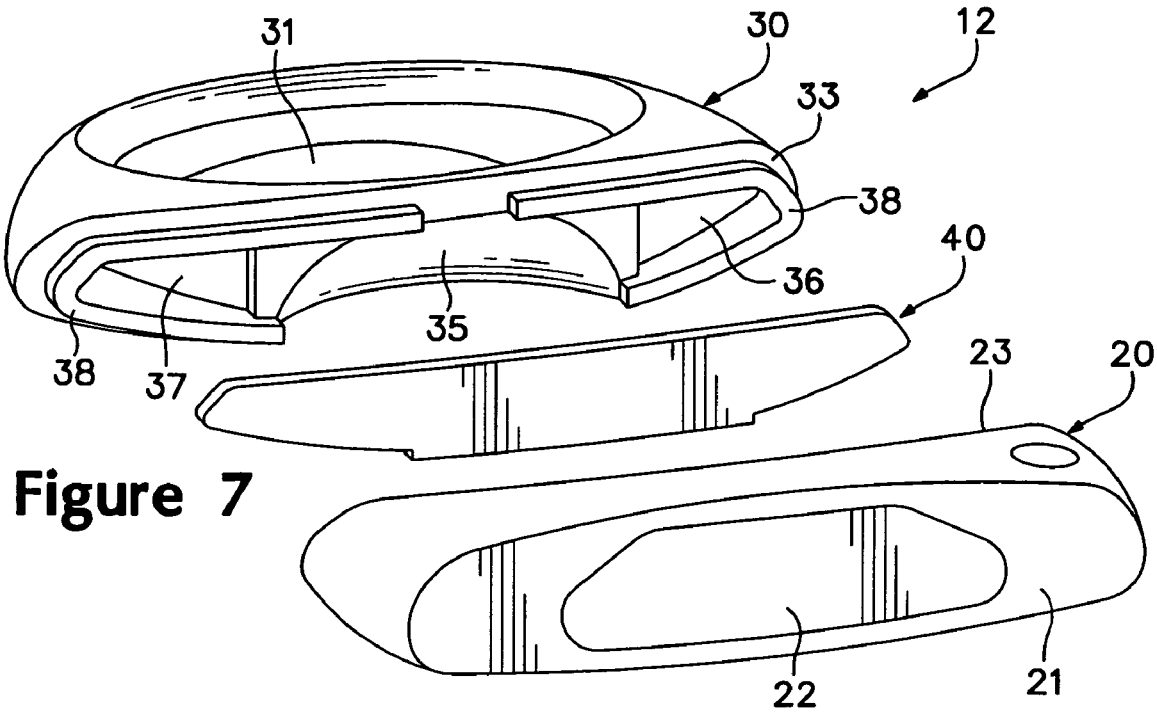
FIG. 7 is an exploded perspective view of the head.

A plurality of cavities are formed in connection side 33, as depicted in the exploded perspective view of FIG. 7. A first cavity 35 is formed within protrusion 34. More particularly, first cavity 35 is formed by the interior surface of protrusion 34, the top surface of protrusion 24, and plate 40. A second cavity 36 is formed in rear portion 30 and adjacent to heel side 13. Similarly, a third cavity 37 is formed in rear portion 30 and adjacent to toe side 14. Plate 40 extends over the exposed sides of cavities 36 and 37, thereby separating cavities 36 and 37 from forward portion 20. In designing head 12, the volume and presence of cavities 35–37 may be modified to impart differing weight characteristics to head 12. For example, cavities 36 and 37 may be filled-in to impart greater weight along the periphery of head 12.

A variety of metal materials may be utilized to form forward portion 20 and rear portion 30, including aluminum, steel, titanium, tungsten, brass, and copper, for example. As will be discussed below, benefits may be gained by forming forward portion 20 from a relatively light material and forming rear portion 30 from a relatively heavy material. As an example, therefore, forward portion 20 may be formed from aluminum and rear portion 30 may be formed from steel. In addition to metal materials, one or both of forward portion 20 and rear portion 30 may be formed from polymer materials or wood, for example.

During the game of golf, an individual grasps the first end of shaft 11 and swings golf club 10 such that head 12 traverses a generally curved path and impacts the golf ball. In comparison with an arc traversed by a head of a driver or iron, for example, the arc traversed by head 12 is relatively small. Once face 21 contacts the golf ball, a portion of the inertia of golf club 10, and particularly the inertia of head 12, is transferred to the golf ball and propels the golf ball toward an intended target. The configuration of head 12 influences the direction traversed by the golf ball following impact with face 21. More particularly, the position of a center of gravity of head 12 and a moment of inertia of head 12 are factors that determine whether the golf ball rolls in a direction that is perpendicular to face 21, or whether the golf ball follows a path that is angled left or right with respect to face 21. In addition, the position of a center of gravity of head 12 may affect whether the golf ball rolls upon impact or slides relative to the ground.

The center of gravity of head 12 is the point at which the entire weight of head 12 may be considered as concentrated so that, if supported at this point, the head 12 would remain in equilibrium in any position. The relative positions of the center of gravity and the point of engagement between the golf ball and face 21 have an effect upon the path followed by the golf ball. In general, the golf ball travels in a direction that is perpendicular to face 21 when the center of gravity is positioned behind the point of engagement. In circumstances where the center of gravity is spaced to a side of the point of engagement, however, the golf ball may angle left or right. This effect is most pronounced when the position of the center of gravity is relatively close to face 21, and this effect diminishes as the distance between the center of gravity and face 21 increases.

Head 12 is designed such that the center of gravity is positioned relatively far from face 21, thereby increasing the probability that the golf ball will travel in a direction that is perpendicular to face 21. One attribute of head 12 that positions the center of gravity relatively far from face 21 is the ring structure of rear portion 30. More particularly, rear portion 30 extends in the rearward direction, and the mass of rear portion 30 that is positioned in rearward areas of the ring structure operates to shift the center of gravity in the rearward direction. Similarly, the materials selected for head 12 also position the center of gravity relatively far from face 21. As discussed above, forward portion 20 may be formed from aluminum and rear portion 30 may be formed from steel. Aluminum is substantially less dense than steel and has, therefore, less mass per unit volume. By forming forward areas of head 12 from aluminum and rearward areas of head 12 from steel, the majority of the mass is concentrated in rearward portions of head 12. Accordingly, the configuration of head 12 and the different materials utilized for forward portion 20 and rear portion 30 position the center of gravity in a spaced relationship with respect to face 21.

The moment of inertia of head 12 also influences the direction traversed by the golf ball following impact with face 21. The moment of inertia is a measure of the resistance of head 12 to angular acceleration about an axis, which generally extends through the center of gravity. That is, the moment of inertia determines the degree to which head 12 resists rotation when propelling the golf ball toward the intended target. When the center of gravity is positioned behind the point of engagement, rotational forces acting upon head 12 are minimized. The rotational forces acting upon head 12 increase, however, in circumstances where the center of gravity is spaced to a side of the point of engagement. The degree to which head 12 rotates in response to the rotational forces depends upon the moment of inertial of head 12.

One manner of increasing the moment of inertia of an object is to concentrate mass in a spaced relationship with an axis of rotation of the object. With regard to head 12, the overall width of head 12 (i.e., the distance between heel side 13 and toe side 14) is relatively large to place a portion of the mass of head 12 in a spaced relationship with an axis of rotation, which may be through the center of gravity. In addition, thicker areas of rear portion 30 are positioned adjacent to heel side 13 and toe side 14. These design considerations, therefore, concentrate the mass of head 12 in a spaced relationship with the axis of rotation of head 12. Accordingly, head 12 is configured to have a relatively large moment of inertia.

The dimensions of head 12 also contribute to the increase in the moment of inertia. In general, a width of head 12 (i.e., a distance from heel side 13 to toe side 14) is greater than a length of head 12 (i.e., a distance from face 21 to a rearmost area of ring portion 30). One set of suitable dimensions for the width and the length are approximately 11 centimeters and 7 centimeters, respectively. However, the width may range from 7 centimeters to 15 centimeters, and the length may range from 4 centimeters to 10 centimeters, for example. Accordingly, the width is generally greater than the length to place a portion of the mass of head 12 in a spaced relationship with an axis of rotation of head 12.

The depth of head 12 (i.e., the distance between upper surface 15 and lower surface 16) tapers between face 21 and the rearmost area of ring portion 30. One suitable set of dimensions for the depth are approximately 2.5 centimeters at face 21 and approximately 1 centimeter in the rearmost area of ring portion 30. The degree of tapering in the depth may vary, however, within the scope of the present invention.

A method of manufacturing head 12 will now be discussed with reference to FIGS. 8–12. In general, three steps are performed to manufacture head 12. Rear portion 30 is formed through casting, molding, or forging, for example, and rear portion 30 is then placed into a mold having the general shape of head 12. Plate 40 may also be placed into the mold with rear portion 30. Forward portion 20 is then cast adjacent to rear portion 30 and plate 40, thereby forming forward portion 20 and bonding rear portion 30 to forward portion 20. The manufacturing method will be discussed below in greater detail.

As an initial step in the manufacturing process for head 12, rear portion 30 is formed. A variety of casting processes are suitable for forming rear portion 30. As an example, rear portion 30 may be formed through investment casting, wherein a wax model of rear portion 30 is encased within a slurry that hardens around the wax model. The hardened slurry is then heated to melt and remove the wax model, thereby forming a mold with a void having the shape of rear portion 30. A molten material, such as steel, is then poured into the void to form rear portion 30. In order to ensure that the molten material extends to all portions of the void, pressure or vacuum may be utilized in a conventional manner. Following solidification of the material within the void, the mold is opened to remove rear portion 30. A benefit of investment casting is that little additional machining is required to form the finished rear portion 30.

Figure 8:
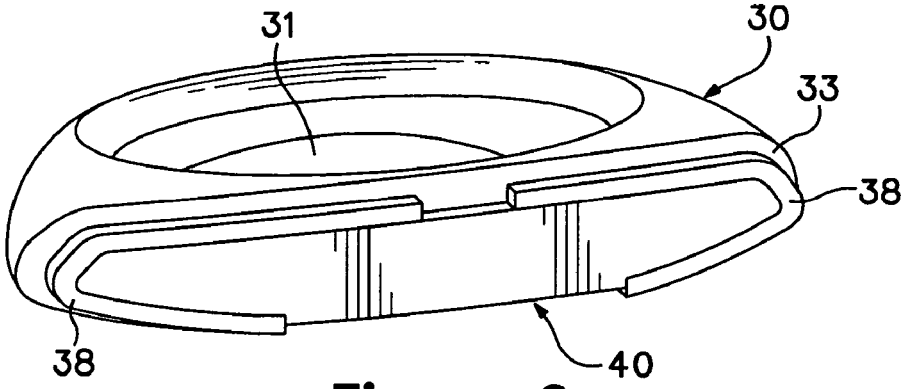
FIG. 8 is a perspective view of a rear portion and a plate portion of the head.

Following the formation of rear portion 30, plate 40 is inserted into connection side 33. With reference to FIGS. 7 and 8, a rim 38 is depicted as extending around cavities 35–37. Plate 40 exhibits the dimensions of the inside dimensions of rim 38 and may be, therefore, press-fitted into connection side 33. As will become apparent in the discussion below, plate 40 prevents molten material from entering cavities 35–37. In embodiments where one or more of cavities 35–37 are not present, the dimensions of plate 40 may be altered, or plate 40 may not be present.

Figure 9:
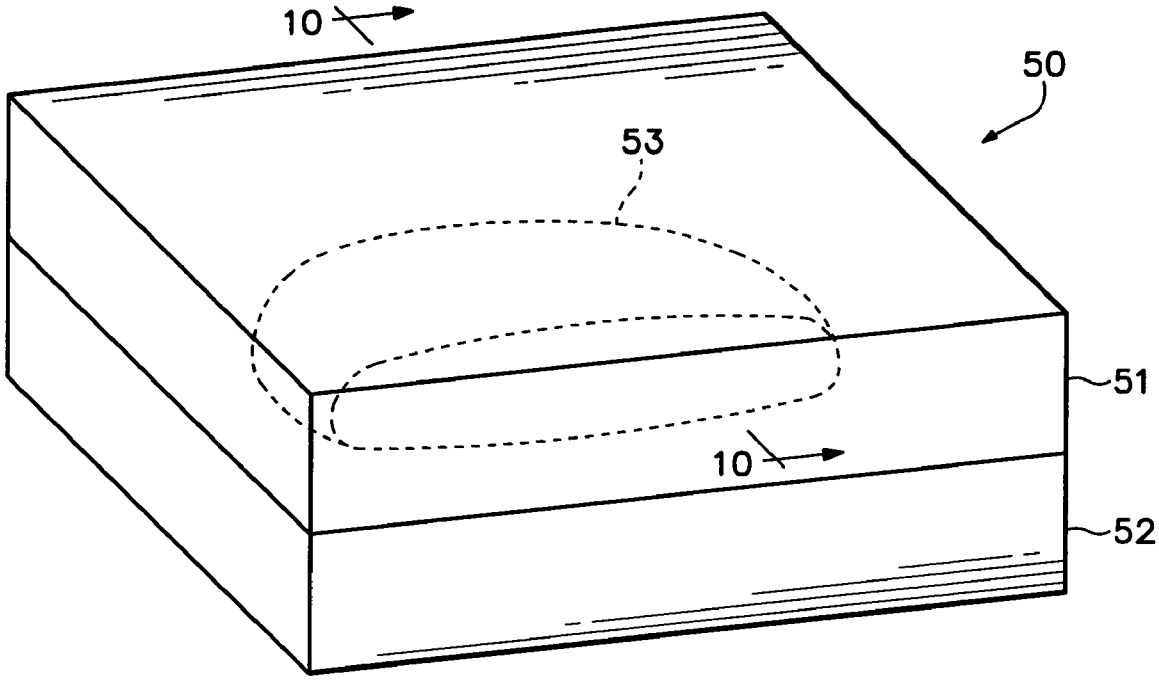
FIG. 9 is a perspective view of a mold utilized in a manufacturing process for the head.

A mold 50 that is utilized to form head 12 is depicted in FIG. 9. Mold 50 includes a first mold portion 51 and a separable second mold portion 52 that cooperatively form a void 53 located on the interior of mold 50. Void 53 has the general shape of head 12 and is formed in each of first mold portion 51 and second mold portion 52. That is, first mold portion 51 includes a depression that has the shape of upper surface 15, and second mold portion 52 also includes a depression that has the shape of lower surface 16. When first mold portion 51 and second mold portion 52 are placed in contact, the depressions form void 53 to have the shape of head 12.

Figure 10:
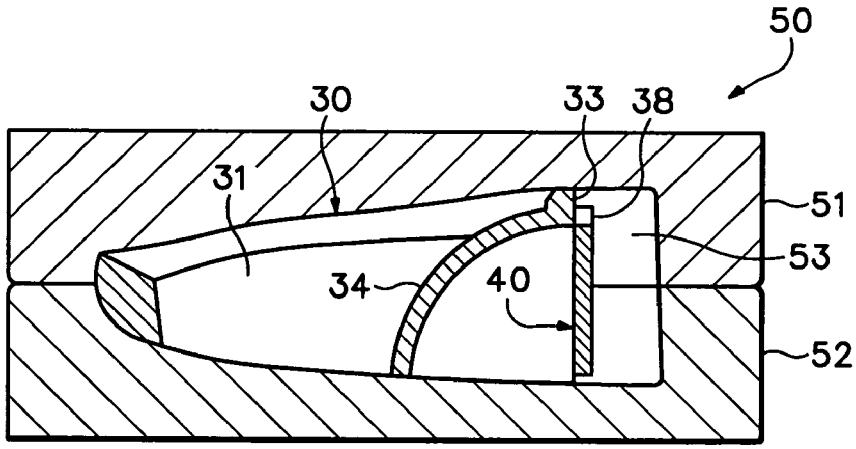
FIG. 10 is a first cross-sectional view of the manufacturing process for the head, as defined along section line 10—10 in FIG. 9.
Figure 11:
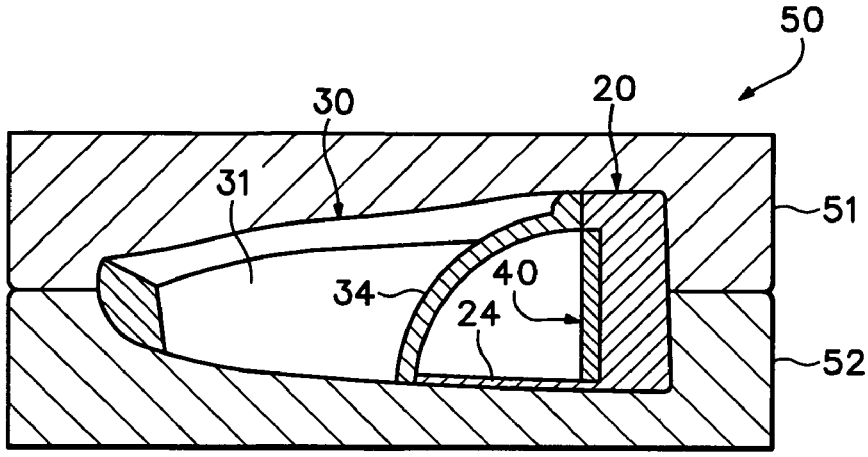
FIG. 11 is a second cross-sectional view of the manufacturing process for the head, as also defined along section line 10—10 in FIG. 9.
Figure 12:
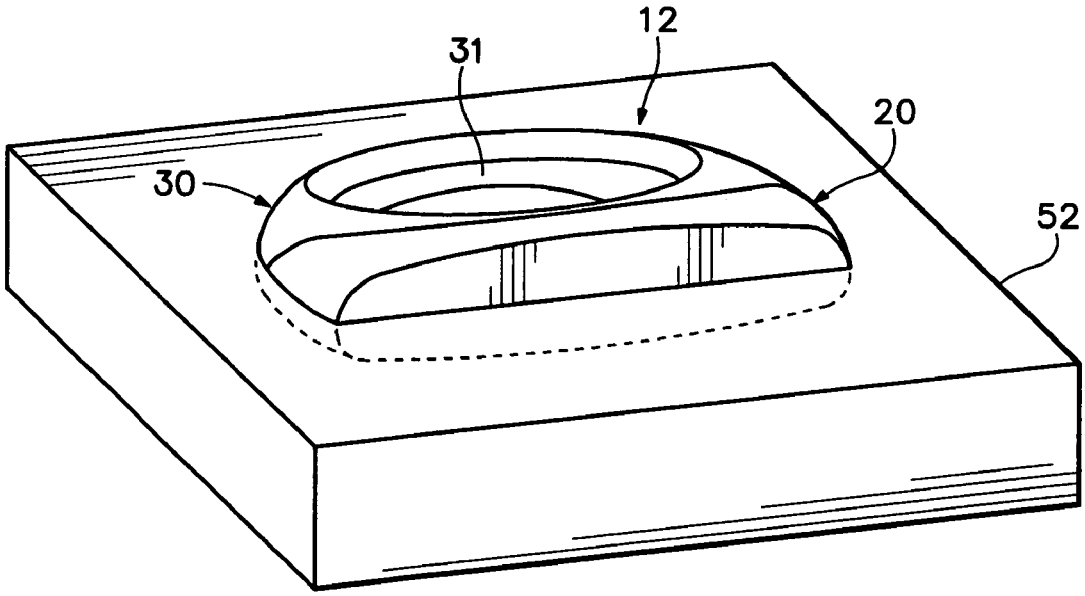
FIG. 12 is a perspective view of a portion of the mold and the head.

Once plate 40 is secured to rear portion 30, the combination of rear portion 30 and plate 40 are placed within void 53, as depicted in FIG. 10. With rear portion 30 and plate 40 positioned within mold 50, the remaining open air space within void 53 includes the volume of void 53 that corresponds with forward portion 20. That is, the remaining open air space within void 53 has the shape of forward portion 20 when rear portion 30 and plate 40 are positioned within void 53. A molten material, such as aluminum, is then introduced into the remaining open air space within void 53 to form forward portion 20, as depicted in FIG. 11. When the molten material is introduced into void 53, the molten material extends around rim 38 and contacts plate 40. The molten material does not, however, significantly enter cavities 35–37 due to the presence of plate 40. Upon solidifying, the material mechanically bonds with rear portion 30 and plate 40, thereby securing forward portion 20 to head 12. Mold 50 may then be opened (i.e., first mold portion 51 is separated from second mold portion 52) for removal of head 12, as depicted in FIG. 12. Insert 22 may then be embedded within face 21 and a degree of machining may be performed to remove surface blemishes that arose during manufacture. Indicia may also be added to identify the manufacturer or provide aesthetic appeal, and the sighting line may be added to substantially complete the manufacture of head 12.

The manufacturing method disclosed above provides an example of a manner in which head 12 may be formed. Various modifications may be made to the manufacturing method within the scope of the present invention. For example, ceramic mold casting, plaster mold casting, die casting, permanent mold casting, powder metallurgy, or sand casting may be utilized in place of investment casting. Furthermore, rear portion 30 may be formed through a forging process. As a further alternative, forward portion 20 may be formed first and placed within mold 50, and then the molten material forming rear portion 30 may be introduced.

The present invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

The invention claimed is:

1. A method of manufacturing a golf club having a bead and a shaft secured to the head, the method comprising steps of:

casting a rear portion of the head with a molten steel material, the rear portion being cast to define an aperture that extends from an upper surface to a lower surface of the head;

placing the rear portion into a mold having a void with a shape of the head; and molding a forward portion of the head by introducing a molten aluminum material into the mold and adjacent the rear portion.

2. The method recited in claim 1, wherein the step of casting further includes defining a protrusion that extends into the aperture.

3. The method recited in claim 1, further including a step of positioning a plate adjacent the roar portion to limit flow of the molten aluminum material.

4. The method recited in claim 3, wherein the step of casting includes defining cavities in the rear portion.

5. The method recited in claim 4, wherein the step of positioning includes locating the plate adjacent the cavities.

6. A method of manufacturing a golf club having a head and a shaft, the method comprising steps of:

casting a rear portion of the head from a molten steel material, the rear portion being cast to define:

an aperture that extends from an upper surface to a lower surface of the head, a protrusion that extends into the aperture, and at least one cavity;

positioning a plate adjacent the at least one cavity;

placing the rear portion and the plate into a mold having a void with a shape of the head; and molding a forward portion of the head by introducing a molten aluminum material into the mold and adjacent the rear portion.

7. The method recited in claim 6, further including a step of securing the head to the shaft.

8. A method of manufacturing a golf club having a head and a shalt secured to the head, the method comprising steps of:

forming a rear portion of the head from a first material, the rear portion having an aperture tat extends from an upper surface to a lower surface of the head, placing the rear portion into a mold having a void with a shape of the head; and molding a forward portion of the head by introducing a second material into the mold and adjacent the rear portion.

9. The method recited in claim 8, wherein the step of forming further includes defining a protrusion that extends into the aperture.

10. The method recited in claim 8, further including a step of positioning a plate adjacent the rear portion to limit flow of the molten aluminum material.

11. The method recited in claim 10, wherein the step of forming includes defining at least one cavity in the rear portion.

12. The method recited in claim 11, wherein the step of positioning includes locating the plate adjacent the cavity.

13. The method recited in claim 8, wherein the step of forming includes casting the rear portion.

14. The method recited in claim 8, further including a step of selecting the first material to be steel and the second material to be aluminum.

* * * * *